US005251908A

United States Patent [19]

Myers

[11] Patent Number: 5,251,908

[45] **Date of Patent: * Oct. 12, 1993**

[54] MULTI SURFACE BOUNCING OBJECT

[76] Inventor: Jeff D. Myers, P.O. Box 12485, Scottsdale, Ariz. 85267

[ * ] Notice: The portion of the term of this patent subsequent to Jan. 7, 2009 has been disclaimed.

[21] Appl. No.: 865,465

[22] Filed: Apr. 9, 1992

Related U.S. Application Data

[63] Continuation-in-part of Ser. No. 749,330, Aug. 23, 1991, Pat. No. 5,131,665, which is a continuation-in-part of Ser. No. 617,545, Nov. 26, 1990, Pat. No. 5,078,408.

[51] Int. Cl.[5] ..... A63B 43/00

[52] U.S. Cl. ..... 273/428; 273/58 BA; 273/58 K

[58] Field of Search ..... 273/428, 58 A, 58 B, 273/58 BA, 58 K, 65 C

[56] References Cited

U.S. PATENT DOCUMENTS

| | | | |
|---|---|---|---|
| 723,606 | 3/1903 | Jacobs | 273/65 C |
| 1,299,092 | 4/1919 | Abrahamson . | |
| 3,887,183 | 6/1975 | Saso | 273/41 |
| 4,239,568 | 12/1980 | Takazawa | 273/58 BA X |
| 4,616,827 | 10/1986 | Berglano | 273/58 B X |
| 4,971,334 | 11/1990 | Stewart | 273/346 |
| 5,028,053 | 7/1991 | Leopold | 273/411 |
| 5,078,408 | 1/1992 | Myers | 273/428 |
| 5,098,329 | 3/1992 | Tseng | 273/58 BA X |
| 5,131,665 | 7/1992 | Myers | 273/428 |

FOREIGN PATENT DOCUMENTS

| | | | |
|---|---|---|---|
| 2508804 | 1/1983 | France | 273/58 A |

*Primary Examiner*—Paul E. Shapiro
*Attorney, Agent, or Firm*—Warren F. B. Lindsley

[57] ABSTRACT

A non-spherical object that responds on impact and rebounds as a spherical ball of a size ranging from one to twelve inches in length and weighing approximately one pound to three pounds in weight.

14 Claims, 2 Drawing Sheets

MULTI SURFACE BOUNCING OBJECT

BACKGROUND OF THE INVENTION

This invention is a continuation in part of U. S. patent application, Ser. No. 07/749,330 filed Aug. 23, 1991, U.S. Pat. No. 5,131,665, and entitled MULTI SURFACE BOUNCING SOLID which in turn is a continuation in part of Ser. No. 617,545, filed Nov. 26, 1990, now U. S. Pat. No. 5,078,408, granted Jan. 7, 1992 entitled BOUNCING CUBE.

This invention relates to a bouncing object and more particularly to a multi-surface object that bounces as a spherical ball.

DESCRIPTION OF THE PRIOR ART

Since man began playing with toys, the spherical ball has been his favorite. Through the ages these spherical balls have been made out of everything from stone, glass, leather and more recently, rubber. A common characteristic of all of the balls has been its round shape. Those made more recently from rubber may be repeatedly bounced in a predictable manner. However, when the object has a shape other than that of a sphere it cannot be bounced in a predictable manner.

U. S. Pat. No. 1,299,092 discloses a hand ball provided with a plurality of substantially plane faces whereby when the ball strikes a rigid surface it rebounds in an uncertain and unexpected direction.

U. S. Pat. No. 3,887,183 discloses a bowling game wherein the projectile is made of rubber or rubber like material and is formed to have ten faces, two of such faces being spaced and parallel and having a generally square form and the other eight having substantially isosceles trapezoidal forms.

U. S. Pat. No. 4,971,334 discloses a throw and catch game including a projectile having a plurality of contiguous flat surfaces on which is placed releasable bonding material. This patent does not disclose a bouncing ball. In fact, the patentee states that the center may be hard plastic which obviously indicates that he did not have a bouncing ball in mind.

U. S. Pat. No. 5,028,053 discloses an erratic bouncing ball comprising a hollow spherical member having twenty-two integral hemispheric projections arranged in a predetermined pattern about its periphery.

A 1966 Catalog containing a publication entitled "Spencer Gifts" disclosed a square ball.

None of these references disclose the claimed invention.

SUMMARY OF THE INVENTION

In accordance with the invention claimed, a new and improved toy is provided in the form of a multi-surfaced object which bounces and rebounds in the manner of a spherical ball.

It is, therefore, one object of this invention to provide a multi-surfaced object that responds on impact and rebounds as a spherical ball.

Another object of this invention is to provide a multi-surfaced object that contains a dense, resilient spherical ball centrally located therewithin which ball is covered by a low density foam like material of a rubber and/or polymetic foam which forms the object with the ball controlling the bounce and rebound characteristics of the object when it is used as a ball for bouncing purposes.

A further object of this invention is to provide a multi-surfaced object the corners of which buckle under impact to insure that a resilient spherical ball at its center controls the bounce and rebound characteristics of the object.

A still further object of this invention is to provide a cubical object that looks and feels like a cube but bounces as a ball.

A still further object of this invention is to provide a cube, triangle, tetrahedron, octahedron, dodecahedron, icosahedron, and any other object having multi vertices all having a high density, resilient rubber spherical ball at its center and covered to form said object with a low density, resilient rubber and/or plastic foam like material.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
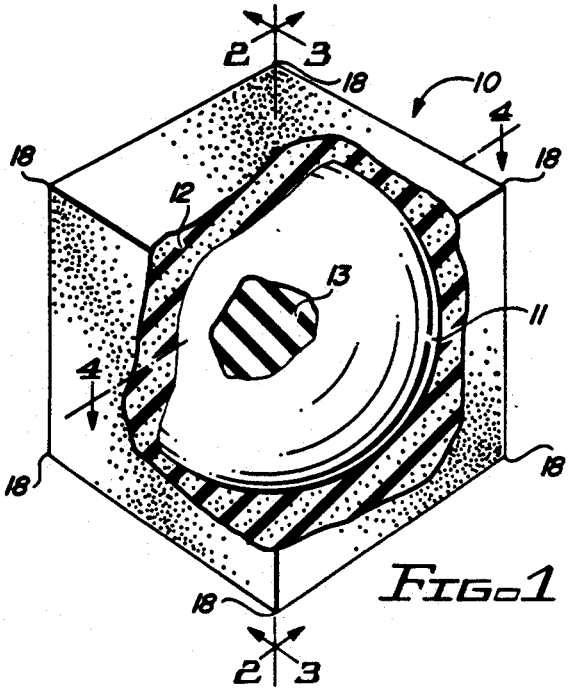
FIG. 1 is a perspective view partially broken away illustrating a cube formed of a low density material surrounding a spherical ball of a denser material and embodying the invention.

Referring more particularly to the drawings by characters of reference, FIGS. 1–4 disclose a cube 10 of a size that may be easily held in the hand of a child or an adult that responds on impact and rebounds like a spherical ball. The size of the cube may range, for example, from one to four inches on a side and should weigh no more than one pound. The cube is intended to feel like a hexahedron or square cubicle object.

The cube surrounds a round object 11 positioned centrally thereof which is intended to have a density greater than the foam rubber or plastic material 12 forming the remainder of the cube. As shown in the drawings, the round object may be a spherical ball formed of, for example, a live rubber or resilient like material 13 having a density of approximately 0.95 to 1.1 times the density of water.

The remainder of the cube, that is all of it except the spherical center, may be formed of a low density resilient rubber or plastic foam like material having a density, for example, of approximately 0.04 to 0.15 times the density of water—the standard in the sciences.

Thus, the composition of the spherical ball or round object 11 may be formed of any live or high compression rubber or other material which has a highly resilient bouncing characteristic. This object is covered with a soft rubber foam or a soft polymeric foam or a reticulated or non-reticulated foam of polyurethane, polyethylene or polyvinyl chloride or any other rubber or rubber plastic material having a capability of bouncing or recoiling.

The outer surface of the cube may be left in its natural state or painted, for example, with a vinyl coating or covered with a thin rubber coating and still fall within the scope of this invention.

Figure 2:
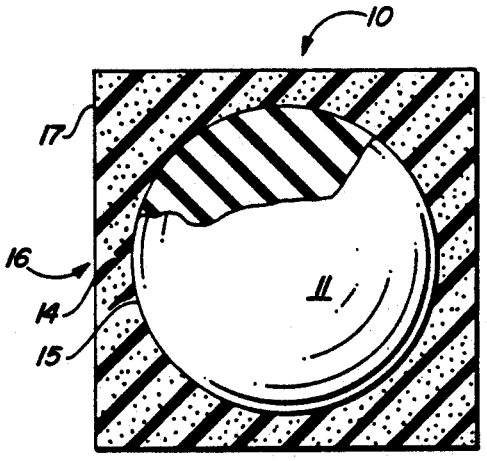
FIG. 2 is a cross sectional view of FIG. 1 taken along the line 2—2.
Figure 3:
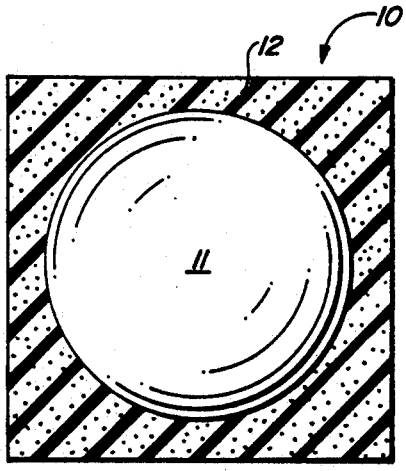
FIG. 3 is a cross sectional view of FIG. 1 taken along the line 3—3.
Figure 4:
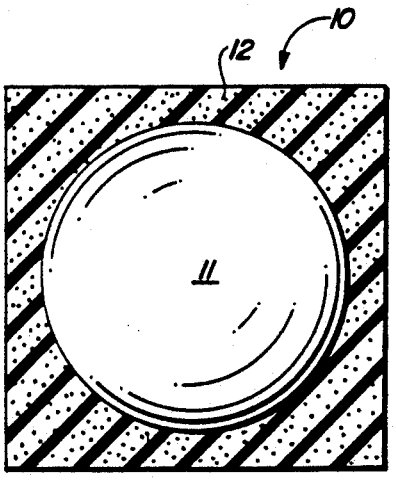
FIG. 4 is a cross sectional view of FIG. 1 taken along the line 4—4.

The thickness of the material, i.e., the distance 14 as shown in FIG. 2, between the surface 15 of the spherical ball 11 and the center 16 of the juxtapositioned outer surface 17 of cube 10 may be approximately 1/16 to ½ of an inch or any other functional measurement.

As designed, the corners 18 of the cube 10 buckle under impact when the cube is bounced or thrown against a wall. Further, the internal sections of the cube also buckle and insure that when hand pressure is applied at the center of the cube's faces, the feel to the handler is similar to the feel of its corners.

The edges of the cube are to be dimensioned as square as it is possible using an injection molding manufacturing process. It has been noted that perfectly square corners of the cube create the instability in the vertices that encourages buckling of the walls of the cube during impact.

The basic approach used is to design the corners (vertices of the object) so that the corners will buckle under impact in such a way that the resulting configuration conforms to the shape that a spherical ball will take under impact. Tests indicate that the corners of the cube disclosed will bend and buckle under impact speeds of 10 inches per second with most of the impact energy available for rebound. At this speed, approximately two inches per second of speed is necessary to provide the buckling forces.

The cube is not designed to roll. Under impact conditions the vertices will buckle resulting in the vertex taking the shape that a sphere takes under impact. The cube must impact at a minimum velocity to insure a rebound similar to that of a sphere.

Figure 12:
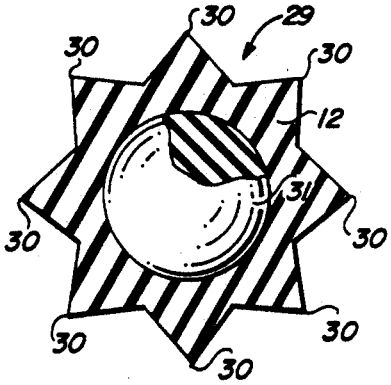
FIG. 12 is a multi-pointed object having a high density spherical ball at its center covered by a low density material forming the object.
Figure 13:
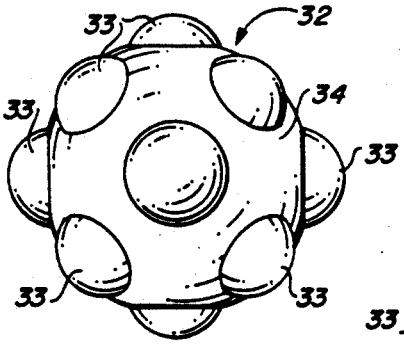
FIG. 13 is a three dimensional object having a plurality of arcuate protrusions equally positioned around its surface.
Figure 14:
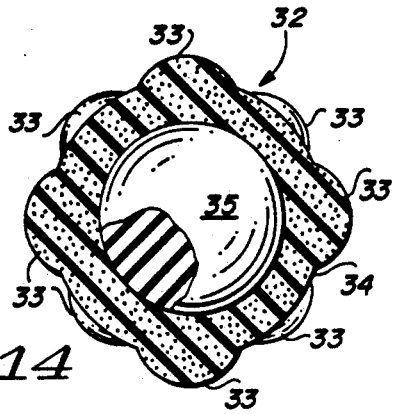
FIG. 14 is a cross sectional view of FIG. 13 showing a high density spherical ball at its center covered by a low density material forming its outer geometrical configuration.

FIGS. 5–14 disclose modifications of the bouncing cube or polyhedrons shown in FIGS. 1–4. The polyhedrons shown in FIGS. 5–11 and the other objects shown in FIGS. 12–14 are intended to illustrate the broad range of geometrical configurations which may be bounced as a ball with like parts given the same reference characters.

Figure 5:
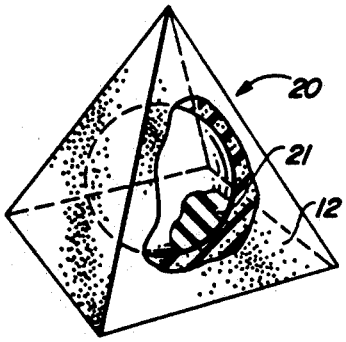
FIG. 5 is a perspective view partially broken away illustrating a tetrahedron formed of a low density material surrounding a spherical ball of a denser material.

More particularly, FIG. 5 illustrates a tetrahedron 20 with each side having a triangular outer plane configuration with a spherical ball 21 centrally positioned within the tetrahedron. Ball 21 comprises a spherical object having the same characteristic as described for ball 11 of FIGS. 1–4 and is covered by foam material 12 heretofore described to form the outer geometrical configuration of the object.

Figure 6:
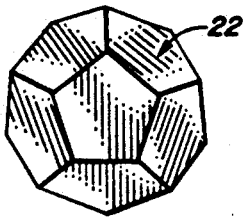
FIG. 6 is a perspective view of a dodecahedron.
Figure 7:
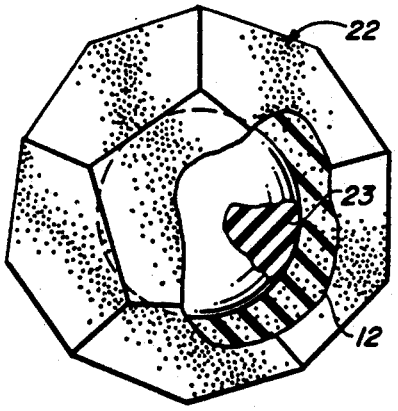
FIG. 7 is a perspective view of a dodecahedron partially broken away showing a high density sphere at its center surrounded by a low density material forming its shape.

FIGS. 6 and 7 illustrate a dodecahedron 22 having a high density resilient spherical ball 23 at its center which is similar to ball 11 heretofore described. The dodecahedron is formed by material 12 overlaying and covering the spherical ball 23.

Figure 8:
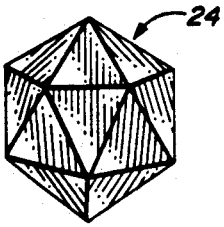
FIG. 8 is a perspective view of an icosahedron.
Figure 9:
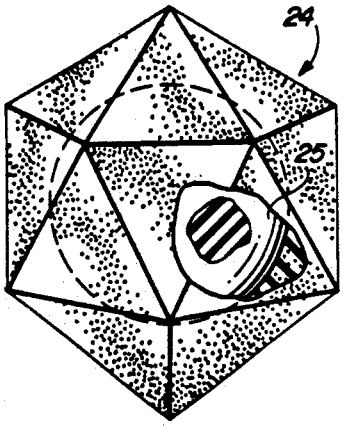
FIG. 9 is a perspective view of an icosahedron partially broken away showing a high density sphere at its center covered by a low density material forming the shape of the icosahedron.

FIGS. 8 and 9 illustrate an icosahedron 24 having a high density resilient ball 25 at its center which is similar to ball 11 of FIGS. 1–4. The icosahedron's geometrical configuration is formed or molded of material 12 around ball 11 in the manner described for FIGS. 1–4.

Figure 10:
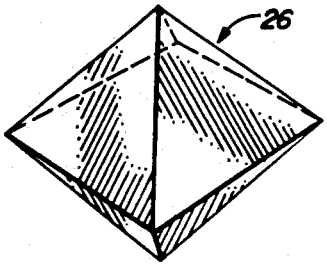
FIG. 10 is a perspective view of an octahedron.
Figure 11:
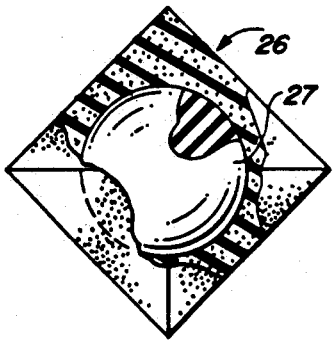
FIG. 11 is a broken away view of an octahedron with a high density sphere at its center covered by a low density material forming the octahedron shape.

FIGS. 10 and 11 illustrate an octahedron 26 having a high density resilient ball 27 at its center which is similar to ball 11 of FIGS. 1–4. The octahedron's geometrical configuration is formed or molded around ball 27 of a material 12 heretofore described for the structure shown in FIGS. 1–4.

FIG. 12 discloses a cross section of a multi pointed object 29 having a uniform design. This cross section illustrates that for every point 30 of the figure on one side of the object there is a corresponding point 30 on the other side such that the two points are symmetric with respect to the object.

At the center of object 29 is a ball 31 of the type heretofore described for FIGS. 1–4 with the rest of the object formed or molded from material 12.

FIGS. 13 and 14 disclose an object 32 having a plurality of arcuate surfaces 33 protruding from the surface 34 of the object. These arcuate surfaces are spacedly arranged in a symetrical pattern around the surface of the object.

Centrally located within object 32 is positioned a spherical high density resilient ball 35 having the same characteristics as ball 11 of FIGS. 1–4 covered by material 12 to form the geometrical configuration of object 32.

Object 32 is intended to illustrate that many different geometrical configurations may form the bouncing object and this invention is not intended to be limited only to the geometrical configurations disclosed.

It should be noted that the spherical ball inside of the device may be an inflatable object and/or a steel insert and still fall within the scope of this invention. Further, the reaction forces of the disclosed objects must be resolved in a direction that passes through the center of gravity of the objects.

Figure 15:
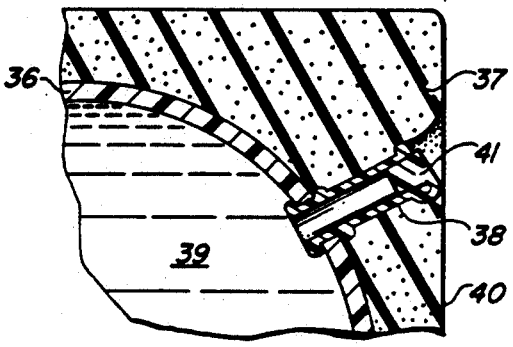
FIG. 15 is a partial cross sectional view of the cube shown in FIGS. 1–4 wherein the sphere or ball at the center of the cube is selectively filled with air under pressure through a valve stem terminating on the outside surface of the cube.

FIG. 15 illustrates an inflatable ball 36 within foam rubber or plastic material 37 which forms a cube of the type shown in FIGS. 1–4. A valve stem 38 structurally connects the hollow interior 39 of ball 36 with the outer surface 40 of the cube. The inlet of valve stem 38 may be closed with the known plug 41.

With regard to FIGS. 5-14, the distance between the outer surface of its centrally positioned spherical ball and the center of the juxtapositioned outer surface of the object should be, for example, approximately 1/16 to ½ of an inch with identical sides thereof being between one to four inches in length. The objects should weigh less than a pound but heavier objects may embody the teaching herein and still fall within the scope of this invention.

It should be noted that a cube ranging in size, for example, from one to twelve inches on a side and weighing from one to three pounds in weight and embodying the invention may be made and still fall within the scope of this invention. This description is intended to cover basketball size and type cubical structures.

Although but a few embodiments of the invention have been shown and described, it will be apparent to those skilled in the art that various changes and modifications may be made therein without departing from the spirit of the invention or from the scope of the appended claims.

What is claimed is:

1. A non-spherical object for tossing against flat surfaces, and which bounces and rebounds from such surfaces as would a spherical ball, the object comprising:
- a spherical ball having the bounceability of a rubber ball,
- a shell completely surrounding the ball, the shell being formed of foam plastic or foam rubber and having a non-spherical exterior contour, the shell being readily and resiliently crushable so that it buckles when the object strikes a flat surface thereby permitting the spherical ball, embedded within the shell, to rebound off that surface, and
- the shell being devoid of any external covering or any means for bonding the object to a surface against which it is tossed.

2. An object as defined in claim 1 wherein the exterior contour of the shell is that of a cube.

3. An object as defined in claim 1 wherein the interior of the spherical ball is hollow and filled with fluid under pressure.

4. An object as defined in claim 3 in further combination with:
- a valve stem extending from an inlet mounted in the outside surface of said shell into the interior of said ball, and
- a plug for selectively closing said inlet of said valve stem.

5. A cube that bounces and rebounds as a spherical ball comprising:
- a spherical ball of relatively high density resilient material forming the center of the cube, and
- a body of relatively low density material surrounding the spherical ball to form a cubical configuration,
- said relatively high density material comprising a material having a density of approximately 0.95 to 1.1 times the density of water,
- said relatively low density material comprising a foam material having a density of approximately 0.04 to 0.15 times the density of water,
- the thickness of said foam material between the center of the surface of each side of the cube and said high density material is approximately 1/16 to ½ of an inch,
- said cube comprises identical sides between one and four inches in length and weighing less than one pound,
- whereby the relatively low density material buckles under impact causing the cube's spherical ball to react to said impact and respond as a ball.

6. The cube set forth in claim 5 wherein:
- said relatively high density material comprises rubber, and
- said relatively low density material comprises a foam plastic material.

7. An object that bounces and rebounds as a spherical ball comprising:
- a spherical ball of relatively high density resilient material forming the center of the object, and
- a body of relatively low density material surrounding the spherical ball to form a given geometrical configuration,
- said relatively high density material comprising a material having a density of approximately 0.95 to 1.1 times the density of water,
- said relatively low density material comprising a foam material having a density of approximately 0.04 to 0.15 times the density of water,
- the thickness of said foam material between the center of the surface of each side of the object and said high density material is approximately 1/16 to ½ of an inch,
- said object comprises identical sides with the distance between said sides being approximately one to four inches in length and weighing less than one pound,
- whereby the relatively low density material buckles under impact causing the object's spherical ball to react to said impact and respond as a ball.

8. The object set forth in claim 7 wherein:
- said spherical ball comprises an object filled with compressed air.

9. The object set forth in claim 7 wherein:
- said relatively high density material comprises rubber, and
- said relatively low density material comprises a resilient foam rubber material.

10. The object set forth in claim 7 wherein:
- said relatively low density material comprises a resilient foam plastic material.

11. A non-spheroid object that bounces and rebounds as a spherical ball comprising:
- a spherical ball of relatively high density resilient material forming the center of the object, and
- a body of relatively low density resilient foam like material surrounding the spherical ball to form a given geometrical configuration,
- said relatively high density material comprising a resilient material having a density of approximately 0.95 to 1.1 times the density of water,
- said relatively low density material comprising a foam material having a density of approximately 0.04 to 0.15 times the density of water,
- the thickness of said foam material between the center of the surface of each side of the object and said high density material is approximately 1/16 to ½ of an inch,
- said object comprises identical sides on each side of a plane passing through its center of approximately one to four inches in length and weighs less than one pound,
- whereby the relatively low density material buckles under impact causing the object's spherical ball to react to said impact and respond as a ball.

12. A cube that bounces and rebounds as a spherical ball comprising:

a spherical ball of relatively high density resilient material forming the center of the cube, and a body of relatively low density material surrounding the spherical ball to form a cubical configuration, said relatively high density material comprising a material having a density of approximately 0.95 to 1.1 times the density of water, said relatively low density material comprising a foam material having a density of approximately 0.04 to 0.15 times the density of water, the thickness of said foam material between the center of the surface of each side of the cube and said high density material is approximately 1/16 to ½ of an inch, said cube comprises identical sides between one and twelve inches in length and weighing from less than one pound to approximately three pounds in weight, whereby the relatively low density material buckles under impact causing the cube's spherical ball to react to said impact and respond as a ball.

13. The cube set forth in claim 12 wherein:

said relatively high density material comprises rubber, and said relatively low density material comprises a foam plastic material.

14. An object set forth in claim 12 wherein:

said spherical ball comprises an object filled with compressed air.

* * * * *